United States Patent [19]

Ansted

[11] 3,978,632

[45] Sept. 7, 1976

[54] FOAM PLASTICS DISPLAY UNIT

[75] Inventor: Roger C. Ansted, San Antonio, Tex.

[73] Assignee: Friedrich Air Conditioning & Refrigeration Co., San Antonio, Tex.

[22] Filed: Nov. 11, 1974

[21] Appl. No.: 522,684

[52] U.S. Cl. ..... 52/309; 52/364; 52/617

[51] Int. Cl.[2] ..... E04C 2/22

[58] Field of Search ..... 52/617, 743, 309, 615, 52/364, 600; 85/36; 297/DIG. 1, DIG. 2; 312/214; 49/503, DIG. 2; 220/9 F, 9 G; 27/3

[56] References Cited

UNITED STATES PATENTS

| | | | |
|---|---|---|---|
| 1,685,254 | 9/1928 | Walper | 52/600 |
| 2,236,929 | 4/1941 | Tinnerman | 85/36 |
| 2,417,262 | 3/1947 | Morehouse | 85/36 |
| 2,754,717 | 7/1956 | Becker | 85/36 |
| 2,876,053 | 3/1959 | Eves | 52/617 |
| 2,924,861 | 2/1960 | Viets | 49/DIG. 2 |
| 3,283,386 | 11/1966 | Cenegy | 52/309 |
| 3,313,073 | 4/1967 | Mathews | 52/617 |
| 3,367,076 | 2/1968 | O'Brien | 52/618 |
| 3,446,692 | 5/1969 | Turnbull | 52/618 |
| 3,488,904 | 1/1970 | Schneller | 52/376 |
| 3,604,748 | 9/1971 | Lamkemeyer | 297/DIG. 1 |
| 3,667,180 | 6/1972 | Tischuk | 52/309 |
| 3,807,116 | 4/1974 | Flynn | 52/615 |
| 3,855,811 | 12/1974 | Sauerbrann | 220/9 F |
| 3,863,277 | 2/1975 | Harrison | 52/309 |

FOREIGN PATENTS OR APPLICATIONS

| | | | |
|---|---|---|---|
| 1,396,538 | 3/1965 | France | 52/615 |
| 790,756 | 2/1958 | United Kingdom | 85/36 |

*Primary Examiner*—Price C. Faw, Jr.
*Assistant Examiner*—Henry Raduazo
*Attorney, Agent, or Firm*—Lane, Aitken, Dunner & Ziems

[57] ABSTRACT

Foam plastic is injected into a hollow space between the inner and outer skin of a refrigeration unit. Contained in the foam plastic are metal plates positioned at points where walls, dividers or shelves may be attached to the refrigeration unit. The foam plastic hardens around the metal plates. Self taping screws drill through the skin, foam plastic and plate to rigidly attach structure being supported to the plate with a minimum amount of heat transfer through the foam plastic and metal plates.

1 Claim, 12 Drawing Figures

FOAM PLASTICS DISPLAY UNIT

BACKGROUND OF THE INVENTION

This invention relates to a method for fastening to foam plastics and, more particularly, to foam plastics used as spacing and insulation in the walls of large refrigeration units. it is essential in refrigeration units that there be a minimum amount of heat transfer through the walls.

DESCRIPTION OF THE PRIOR ART

Foam plastics have been used for a number of years in the walls of refrigeration units. Foam plastics are among the more economical types of spacing material to use, and still have the satisfactory results of a minimum amount of heat transfer through the walls. Most refrigeration units have a thin inner and outer shell with the foam plastic being injected between the inner and outer shell. If it becomes necessary to attach something to the wall of the refrigeration unit, it is very difficult to anchor anything to the thin skin and/or foam plastic.

Prior to the present invention, the most common method utilized in attaching something to the wall of a refrigeration unit was to simply locate wooden blocks in the wall at the point where the device was to be anchored. The foam plastic would be injected between the inner and outer skin and around the wooden block. The wooden block would be totally contained within the inner and outer skin of the refrigeration unit. These wooden blocks may be located anywhere within the walls of a refrigeration unit where structure needs to be attached and anchored. A wood screw would then hold the structure in place. A problem with using wooden blocks as anchor supports is the cost of wood.

SUMMARY OF THE INVENTION

The present invention provides the means for attaching structure to the walls of a refrigeration unit having a thin inner and outer skin with the space in between filled with foam plastic.

It is an object of the present invention to provide a method for attaching to foam plastic in the walls of refrigeration units by locating metal plates at the points where structure is to be anchored to the foam plastic.

It is a further object of the present invention to make the walls of the refrigeration unit by locating metal plates at points where structure is to be anchored, and thereafter injecting foam plastic between the inner and outer skin of the refrigeration unit and allowing the foam plastic to harden.

It is yet another object of the present invention to anchor structure items such as ribs or shelf supports to metal plates located in foam plastic in the walls of a refrigeration unit.

It is even another object of the present invention to attach to the metal plates contained in the foam plastic by means of self drilling screws that will drill through the outer skin, foam plastic and plate to anchor itself in the plate.

It is yet another object of the present invention to secure the metal plates into position while the foam is being injected between the inner and outer skin by any convenient means such as tape or glue.

In the construction of a large refrigeration unit, the outer skin is located in position and the metal plates are secured thereto. A typical way of holding the metal plates in position would be by tape or glue wherein the metal plates are attached to either the outer skin or the ends of the refrigeration unit. The inner skin is then located in position and the foam plastic is injected into the space between the inner and outer skin. Thereafter when the foam plastic hardens other structure such as ribs or shelf supports may be anchored into the foam plastic by means of a screw extending through the outer skin, foam plastic and into the metal plate. The metal plate is typically a sixteenth of an inch thick so that it will give considerable structural support to the screw anchored therein. The screw anchored in the metal plate would then hold an angle bracket or other structure in a rigid position inside the refrigeration unit.

DESCRIPTION OF THE PREFERRED EMBODIMENT

Figure 1:
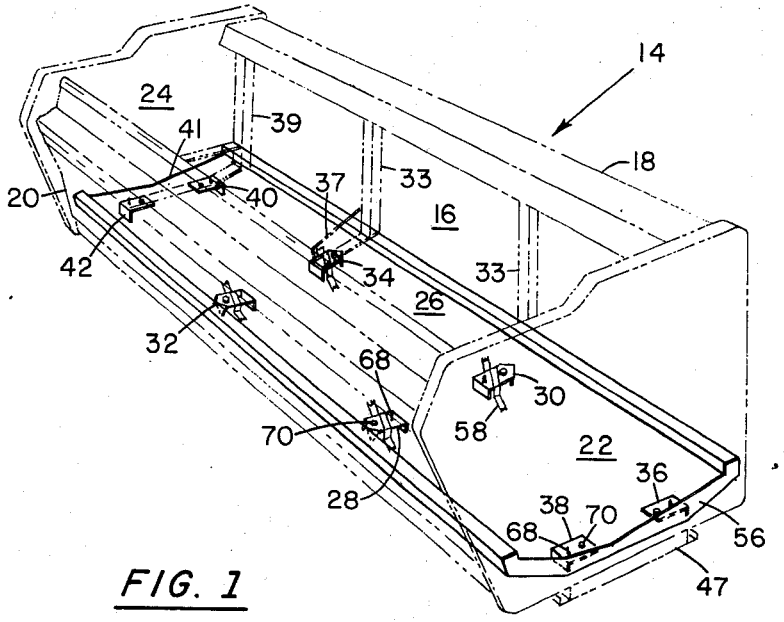
FIG. 1 is an illustrative pictorial view of a display type refrigeration unit shown in phantom lines with the bottom wall being constructed from foam plastic having plates located therein.

Referring now to FIG. 1 of the drawings, there is shown pictorially (in phantom lines) a display type refrigeration unit represented generally by the reference numeral 14. The display type refrigeration unit consists generally of a rear wall 16, a partial top 18 that may contain display lighting underneath, front wall 20, end walls 22 and 24 and bottom wall 26. The mechanical portion of the refrigeration unit 14, such as the evaporator coil and fans and related ducts are not shown in the pictorial illustration.

The present invention of providing a new method for attaching to foam plastics is described only in conjunction with the bottom wall 26, however, it could be utilized with respect to any wall of the refrigeration unit 14 that is formed from foam plastics and needs some way to anchor structure of the refrigeration unit 14 such as shelves or dividers. Assume that the refrigeration unit 14 is being divided into three compartments with shelves located in each compartment. Since at least two dividers will be necessary to form the three compartments, center plates 28 and 30 will be located at the point where one divider is to be anchored, and center plates 32 and 34 will be located where the other divider is to be anchored. Since any shelves will have to be anchored at both the dividers and the ends of the refrigeration unit 14, end plates 36 and 38 will provide the means for anchoring at end wall 22 and end plates 40 and 42 will provide the means for anchoring at end wall 24.

Figure 2:
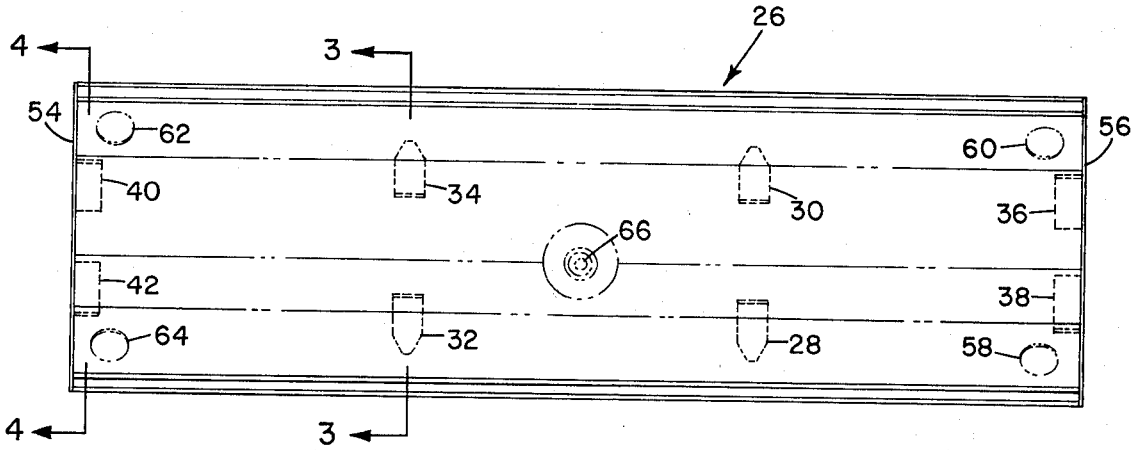
FIG. 2 is a top view of the bottom wall shown in FIG. 1.
Figure 3:
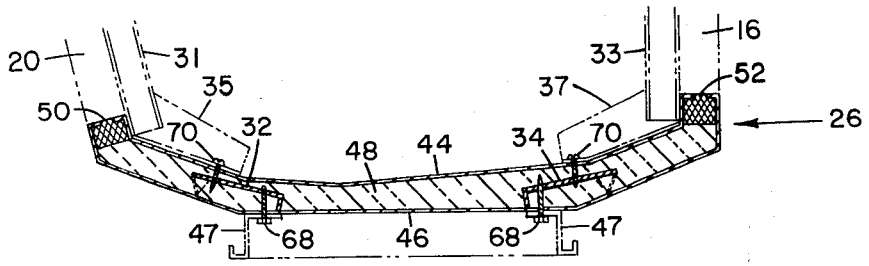
FIG. 3 is a section view of FIG. 2 along section lines 3—3.

Referring now to FIG. 2, there is shown a top view of bottom wall 26 with the center plates 28, 30, 32 and 34 and end plates 36, 38, 40 and 42 being shown in broken lines. Referring to FIGS. 2 and 3 in combination, the internal structure of bottom wall 26 can best be understood. Bottom wall 26 has a thin inner skin 44 that is made from a thin corrosive resistant metal substance. An outer skin 46 is also very thin and made from a corrosive resistant metal substance. Between the inner skin 44 and outer skin 46 is located polyurethane foam plastic 48 that provides insulation and support for the thin inner and outer skins 46 and 48. The polyurethane foam plastic 48 is injected in the unreacted mixed state, as will be subsequently described, and allowed to harden.

Between the inner skin 44 and the outer skin 46 and immediately under the front wall 20 is located a strip of styrofoam 50. Under the rear wall 22 is a strip of styrofoam 52 also located between the inner skin 44 and the outer skin 46. The strips of styrofoam 50 and 52 are bonded to the outer skin by any convenient means such as an adhesive that will melt and bond the two together when hot. The inner skin 44 is allowed to float against the strips of styrofoam without the inner skin 44 ever touching the outer skin 46 although it too could be fastened to the styrofoam 50 and 52.

Figure 5:
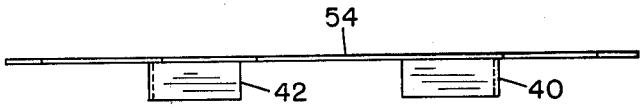
FIG. 5 is a top view of the left end of the bottom wall shown in FIG. 2 with the metal plates being glued thereto.
Figure 6:
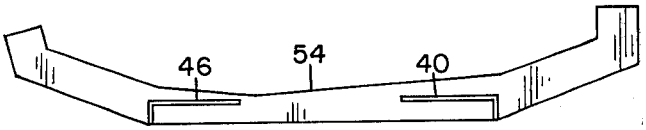
FIG. 6 is an elevated view of FIG. 5.
Figure 7:
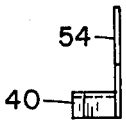
FIG. 7 is an end view of FIG. 6.

Before the polyurethane foam plastic 48 can be injected between the inner skin 44 and outer skin 46 the end portions must be sealed shut. At each end of the bottom wall 26 is located a one eighth inch thick piece of hardboard 54 and 56 such as masonite. The hardboard 54 and 56 can be seen in more detail in FIGS. 5–7. The hardboard strip 54 is cut to fill the end portion between the inner skin 44 and outer skin 46. To the strip of hardboard 54 is bonded end plates 40 and 42 by any conventional method such as glueing. The bonding of the end plates 40 and 42 is necessary to hold the plates into position during the injection of the foam plastic 48. End plates 36 and 38 are held in position by a similar process of bonding to a piece of hardboard 56.

The center plates 28, 30, 32 and 34 are positioned at their desired location as shown in FIGS. 1 and 2. To hold the center plates 28, 30, 32 and 34 into position during foaming, a piece of tape 58 (shown in FIG. 1) reaches across each of the center plates 28, 30, 32 and 34 and holds the center plates 28, 30, 32 and 34 against the outer skin 46. The tape 58 may be left imbedded in the foam plastic after it hardens without any appreciable effect.

After bonding the end plates 36 and 38 to the piece of hardboard 56 and end plates 40 and 42 to piece of hardboard 54, plus taping the center plates 28, 30, 32 and 34 into position against the outer skin 46, and assembling the various portions together with the inner skin 44 being floated on the strips of styrofoam 50 and 52, the bottom wall 26 is ready for injection of the polyurethane foam plastic. The polyurethane foam plastic 48 is then injected at various points until it is spread throughout the space between inner skin 44 and outer skin 46. Once injected the polyurethane foam plastic 48 is permitted to expand and harden thereby forming a solid bottom wall that provides good insulation.

In FIG. 2 there are shown holes 58, 60, 62 and 64 in each of the four corners of the bottom wall 26. The holes 58, 60, 62 and 64 have been cut through the inner skin 44 and outer skin 46. When the polyurethane foam plastic 48 is being injected between inner skin 44 and outer skin 46, the holes 58, 60, 62 and 64 are plugged by any conventional means such as a plastic plug or tape. Since most of the refrigeration unit's mechanical parts will be at a remote location from the display unit shown in FIG. 14, the cooling ducts must enter the refrigeration unit 14 through bottom wall 26. The holes 58, 60, 62 and 64 provide a means for the refrigeration ducts to enter the refrigeration unit 14. According to which holes 58, 60, 62 or 64 are necessary, depending upon the individual installation, the foam plastic 48 for that hole may be cut out and the refrigeration duct run into the refrigeration unit 14. It should be realized that any number of methods for running the refrigeration lines inside of refrigeration unit 14 may be utilized.

Figure 4:
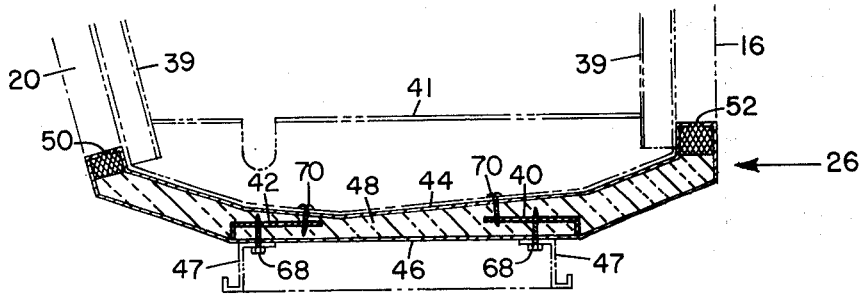
FIG. 4 is a section view of FIG. 2 along section lines 4—4.

Also shown in FIG. 2 is a drain hole 66 whereby any moisture that collects inside of refrigeration unit 14 may drain through the bottom wall 46 or the unit 14 may be washed out. All portions of the inner skin 44 slope downward towards the waste outlet 66 to insure proper drainage. Referring now to FIGS. 1, 3 and 4 in combination, it is necessary in most large refrigeration units such as 14 to have dividers of shelf space. Each of the center and end plates 28, 30, 32, 34, 36, 38, 40 and 42 are anchored from the bottom by means of self drilling screws 68. The screws 68 also hold a base flange 47 into position, base flange 47 extending from one end to the other of refrigeration unit 14. These self drilling screws 68 are typically one quarter inch in diameter, yet being short enough so that after drilling and screwing into their respective plate they will not reach the inner skin 44. Extending through the inner skin 44 and into the plates 28, 30, 32, 34, 36, 38, 40 and 42 are self drilling screws 70. The screws 70 attach either left foot 31 and extension 35, right foot 33 and extension 37 (see FIG. 3), or end legs 39 and plate 41 (see FIG. 4). The self drilling screws 70 are typically number ten screws having a total length so that the self drilling screw 70 will not reach outer skin 46. The self drilling screws 70 are the ones that are used to mount structure such as dividers or shelves inside of refrigeration unit 14 with the structure being attached to feet 31 and 33 or legs 39. For example, an angle bracket forms extensions 35 and 37, and even end plate 41, all of which can be held into position by self drilling screws 70 with the angle bracket supporting the feet 31 and 33 and legs 39.

Figure 8:
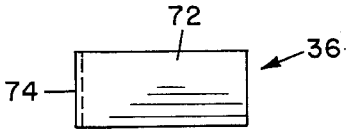
FIG. 8 is a top view of the metal plates used in the ends of the bottom wall.
Figure 9:
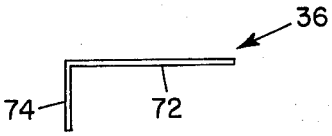
FIG. 9 is an elevated view of FIG. 8.

Referring now to FIGS. 8 and 9, there is shown a typical example of the end plates 36, 38, 40 and 42 with the example being end plate 36. The end plate 36 has a horizontal flat surface 72 and a vertical surface 74. The end plate 36 need only be strong enough to retain the self drilling screws 68 and 70 in a rigid position for locating additional structure inside of refrigeration unit 14. For the present use in refrigeration unit 14 the end plate 36 may be made from fourteen gauge galvanized steel having a one eighth inch radius between the horizontal surface 72 and vertical surface 74.

Figure 12:
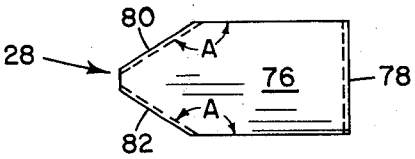
FIG. 12 is a top view of FIG. 11.
Figure 10:
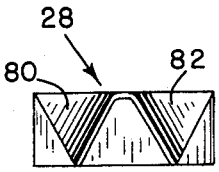
FIG. 10 is an end view of the metal plates used in the center of the bottom wall.
Figure 11:
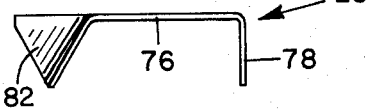
FIG. 11 is a side view of FIG. 10.

Referring now to FIGS. 10, 11 and 12 there is shown a typical example of the center plates 28, 30, 32 and 34 with the example being center plate 28. The center plate 28 is substantially similar to end plate 36 with horizontal surface 76 and vertical surface 78 and a one eighth inch radius therebetween. However, center plate 28 has additional bends wherein the corners of horizontal surface 76 are folded downward to the vertical position to form extension 80 and 82. The angle between downward extensions 80 and 82 and their respective outer edge represented by the angle A is approximately 135 degrees. The center plates as represented by center plate 28 can be made from sixteen gauge cold rolled steel with all bends having one eighth inch radius.

What is claimed is:

1. A display unit comprising an inner skin, an outer skin extending in a spaced relation to said inner skin, two end pieces secured to said skins at the ends of the space between said skins, a plurality of support plates located in said space with at least a portion of said plates being secured to said end pieces, a hardened foam plastic material extending in said space and surrounding at least a portion of each of said plates for bonding said skins and said plates relative to each other and forming a unitary structure, a plurality of support brackets for supporting additional components of said display unit, and screw means extending through said support brackets, at least one of said skins, a portion of said foam plastic, and into said plates for securing said support brackets to said structure.

* * * * *